US010942462B2

(12) United States Patent
Ito et al.

(10) Patent No.: US 10,942,462 B2
(45) Date of Patent: Mar. 9, 2021

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Yota Ito, Mishima (JP); Akira Sakakibara, Susono (JP); Jumpei Kuno, Yokohama (JP); Shuhei Iwasaki, Yokohama (JP); Kohei Makisumi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/668,896

(22) Filed: Oct. 30, 2019

(65) Prior Publication Data

US 2020/0159137 A1 May 21, 2020

(30) Foreign Application Priority Data

Nov. 19, 2018 (JP) ..... JP2018-216456

(51) Int. Cl.
*G03G 5/00* (2006.01)
*G03G 5/14* (2006.01)
(Continued)

(52) U.S. Cl.
CPC ..... *G03G 5/144* (2013.01); *G03G 5/056* (2013.01); *G03G 5/0614* (2013.01);
(Continued)

(58) Field of Classification Search
CPC ..... G03G 5/144
(Continued)

(56) References Cited

U.S. PATENT DOCUMENTS 9,029,054 B2 5/2015 Okuda et al.
9,063,505 B2 6/2015 Sekiya et al.
(Continued)

FOREIGN PATENT DOCUMENTS

JP 2002-287396 10/2002
JP 2005-338445 12/2005
(Continued)

*Primary Examiner* — Mark A Chapman
(74) *Attorney, Agent, or Firm* — Venable LLP

(57) ABSTRACT

The present disclosure provides an electrophotographic photosensitive member that reduces the accumulation of charge and the leakage which are caused by a repeated use in a long period of time. The electrophotographic photosensitive member has a support, an undercoat layer, a charge generation layer and a charge transport layer in this order, wherein the undercoat layer contains a polyamide resin, and a titanium oxide particle, wherein the titanium oxide particle has been surfacetreated with an organosilicon compound, wherein the undercoat layer satisfies $10 \leq \alpha \leq 70$, where $\alpha$ represents a degree [%] of hydrophobicity of the titanium oxide particle which has been surfacetreated with the organosilicon compound; and the undercoat layer satisfies $0.015 \leq (\beta \times \gamma) \leq 0.040$, where $\beta$ represents an average primary particle size [μm] of the titanium oxide particles, and $\gamma$ represents a weight percentage [wt %] of an Si element of the organosilicon compound with respect to the titanium oxide particle.

11 Claims, 1 Drawing Sheet

(51) Int. Cl.

| | |
|---|---|
| ***G03G 5/06*** | (2006.01) |
| ***G03G 15/00*** | (2006.01) |
| ***G03G 5/05*** | (2006.01) |
| ***G03G 21/18*** | (2006.01) |

(52) U.S. Cl.
CPC ..... *G03G 5/0696* (2013.01); *G03G 15/75* (2013.01); *G03G 21/1814* (2013.01)

(58) Field of Classification Search
USPC ..... 430/60, 63, 65
See application file for complete search history.

(56) References Cited

U.S. PATENT DOCUMENTS

| | | | | |
|---|---|---|---|---|
| 9,069,267 | B2 | 6/2015 | Kaku et al. | |
| 9,523,929 | B2 | 12/2016 | Nakamura et al. | |
| 9,535,346 | B2 | 1/2017 | Sekiya et al. | |
| 9,772,569 | B2 | 9/2017 | Tanaka et al. | |
| 9,851,646 | B2 | 12/2017 | Tomono et al. | |
| 10,416,581 | B2 | 9/2019 | Ito et al. | |
| 10,452,021 | B2 | 10/2019 | Miura et al. | |
| 10,545,453 | B2 | 1/2020 | Iwasaki et al. | |
| 2012/0051786 | A1* | 3/2012 | Katayama ..... | G03G 5/0525 399/159 |
| 2015/0185630 | A1 | 7/2015 | Ito et al. | |
| 2015/0185634 | A1 | 7/2015 | Sekiya et al. | |
| 2019/0163119 | A1 | 5/2019 | Yamaai et al. | |

FOREIGN PATENT DOCUMENTS

| | | |
|---|---|---|
| JP | 2010-230746 | 10/2010 |
| JP | 2013-222091 | 10/2013 |

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present disclosure relates to an electrophotographic photosensitive member, and a process cartridge and an electrophotographic apparatus having the electrophotographic photosensitive member.

Description of the Related Art

An electrophotographic photosensitive member containing an organic photoconductive material (charge generation material) is used as an electrophotographic photosensitive member mounted on a process cartridge or an electrophotographic apparatus. The electrophotographic photosensitive member generally has a support, and a photosensitive layer formed on the support; and has a charge generation layer, and a charge transport layer formed on the charge generation layer. As for the photosensitive layer, a stacked type photosensitive layer is preferably used in which a charge transport layer containing a charge transport material is stacked on a charge generation layer containing a charge generation material. Furthermore, an undercoat layer is provided between the support and the charge generation layer in many cases, for the purpose of enhancing an adhesion between the support and the photosensitive layer, reducing the charge injection from the support to the charge generation layer side, and reducing the occurrence of fogging, leakage and the like due to local degradation of a charging property.

An undercoat layer is used in which titanium oxide particles are dispersed in a polyamide resin, as an undercoat layer that reduces the charge injection from the support to the charge generation layer side and reduces the occurrence of fogging, leakage and the like due to local degradation of the charging property.

In recent years, a longer-life electrophotographic apparatus is required, and an undercoat layer that accumulates less charge is required for stability for repeated use of the electrophotographic photosensitive member in a long period of time, and environmental stability.

As for the undercoat layer that accumulates less charge and reduces local degradation of the charging property, Japanese Patent Application Laid-Open No. 2002-287396 describes a technology of using a titanium oxide particle of which the degree of hydrophobicity has been adjusted.

In addition, Japanese Patent Application Laid-Open No. 2010-230746 describes a technology of adjusting a ratio of an organosilicon compound on a surface of a titanium oxide particle to be used.

SUMMARY OF THE INVENTION

The electrophotographic photosensitive member of the present disclosure is an electrophotographic photosensitive member having a support, an undercoat layer, a charge generation layer and a charge transport layer in this order, wherein the undercoat layer contains a polyamide resin, and a titanium oxide particle, wherein the titanium oxide particle has been surfacetreated with an organosilicon compound; wherein the undercoat layer satisfies Expression (i): $10 \leq \alpha \leq 70$, where $\alpha$ represents a degree [%] of hydrophobicity of the titanium oxide particle which has been surfacetreated with the organosilicon compound; and the undercoat layer satisfies Expression (ii): $0.015 \leq (\beta \times \gamma) \leq 0.040$, where $\beta$ represents an average primary particle size [μm] of the titanium oxide particles which have been surfacetreated with the organosilicon compound, and $\gamma$ represents an weight percentage [wt %] of an Si element in the titanium oxide particle which has been surfacetreated with the organosilicon compound.

In addition, the present disclosure relates to a process cartridge having and integrally supporting the above electrophotographic photosensitive member and at least one unit selected from the group consisting of a charging unit, a developing unit and a cleaning unit, the process cartridge being detachably attachable to the main body of the electrophotographic apparatus.

In addition, the present disclosure relates to an electrophotographic apparatus having the above electrophotographic photosensitive member, and a charging unit, an exposure unit, a developing unit and a transfer unit.

Further features of the present disclosure will become apparent from the following description of exemplary embodiments with reference to the attached drawings.

DESCRIPTION OF THE EMBODIMENTS

Figure 1:
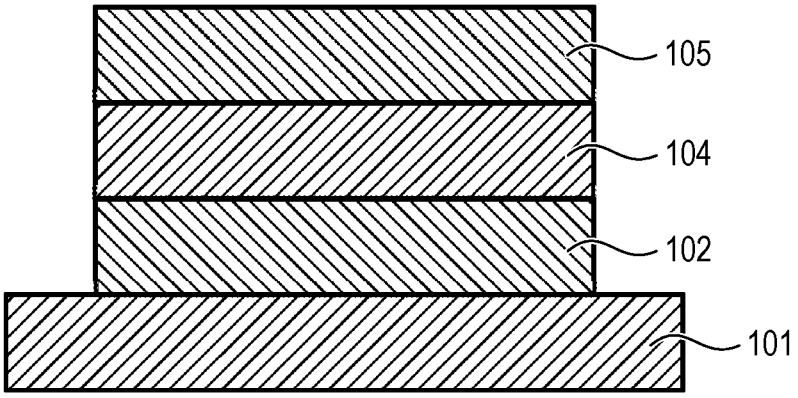
FIG. 1 is a view illustrating one example of a layer configuration of an electrophotographic photosensitive member.

Preferred embodiments of the present disclosure will now be described in detail in accordance with the accompanying drawings.

In recent years, a long-life electrophotographic photosensitive member has been desired, and an electrophotographic photosensitive member is demanded in which an undercoat layer achieves both reductions of the accumulation of charge and the leakage at a high level, in order to give stability for repeated use in a long period of time and environmental stability, to the electrophotographic photosensitive member.

As a result of investigation by the present inventors, it has been found that in the technologies disclosed in Japanese Patent Application Laid-Open Nos. 2002-287396 and 2010-230746, the reduction of the accumulation of charge or the leakage is not sufficient in some cases, when the electrophotographic photosensitive member has been repeatedly used in a long period of time.

An object of the present disclosure is to provide: an electrophotographic photosensitive member that reduces the accumulation of charge and the leakage which are caused by the repeated use in a long period of time; and a process cartridge and an electrophotographic apparatus that have the electrophotographic photosensitive member.

The electrophotographic photosensitive member of the present disclosure is an electrophotographic photosensitive member having a support, an undercoat layer, a charge generation layer and a charge transport layer in this order, wherein the undercoat layer contains a polyamide resin, and a titanium oxide particle, wherein the titanium oxide particle has been surfacetreated with an organosilicon compound; the undercoat layer satisfies Expression (i): $10 \leq \alpha \leq 70$, where α represents a degree [%] of hydrophobicity of the titanium oxide particle which has been surfacetreated with the organosilicon compound; and the undercoat layer satisfies Expression (ii): $0.015 \leq (\beta \times \gamma) \leq 0.040$, where represents an average primary particle size [μm] of the titanium oxide particles which have been surfacetreated with the organosilicon compound, and γ represents an weight percentage [wt %] of an Si element in the titanium oxide particle which has been surfacetreated with the organosilicon compound.

The present inventors assume the reason why such an electrophotographic photosensitive member reduces the accumulation of charge and the leakage even after the repeated use in a long period of time, as follows.

Conventionally, an undercoat layer has been used in which titanium oxide particles are dispersed in a polyamide resin. The surface of the titanium oxide particle can reduce the hydroxyl groups existing thereon by inorganic treatment or organic treatment, to impart hydrophobicity to itself. It has been investigated to obtain a desired undercoat layer by enhancing the dispersibility in the polyamide resin, and appropriately adjusting a state of the surface of the titanium oxide particle, by these surface treatments.

In the present disclosure, in order to obtain an electrophotographic photosensitive member that reduces the accumulation of charge and the leakage which are caused by the repeated use in a long period of time, and particularly in order to achieve the reduction of a potential fluctuation in a low temperature and low humidity environment and the reduction of the leakage at the time of a high electric field, at a high level, the present inventors has paid attention to a degree of hydrophobicity of the titanium oxide particle and a weight percentage of an Si element.

When the degree of hydrophobicity, α[%], of the titanium oxide particle surface-treated with the organosilicon compound satisfies Expression (i): $10 \leq \alpha \cdot 70$, the dispersibility of the titanium oxide particle in the polyamide resin is enhanced to provide an effect of reducing the leakage at the time of the high electric field. When the degree of hydrophobicity is within a range of Expression (i), the cases does not occur where the effect of reducing the leakage at the time of the high electric field does not become a satisfactory level, and where the dispersibility in the polyamide resin is insufficient owing to types of the organosilicon compound. Furthermore, when the degree of hydrophobicity is within a range of Expression (i), the dispersibility in the polyamide resin is not impaired, and the effect of reducing a potential fluctuation originating from non-uniformity in a low temperature and low humidity environment is a satisfactory level.

The present inventors have found that there is a more favorable value of a weight percentage of the Si element, γ[wt %], in the titanium oxide particle which has been surfacetreated with the organosilicon compound according to the average primary particle size β [μm] of the titanium oxide particles which have been surfacetreated with the organosilicon compound. Specifically, by satisfying Expression (ii): $0.015 \leq (\beta \times \gamma) \leq 0.040$, the effect of reducing the potential fluctuation in a low temperature and low humidity environment and the effect of reducing the leakage at the time of the high electric field can be obtained.

In the titanium oxide particle which has been surface-treated with the organosilicon compound, it is considered that the value of a specifies the hydrophobicity of the surface which includes the organic compound covering the surface of the titanium oxide particle, and the value of β×γ specifies the hydrophobicity of the surface of the titanium oxide particle. In the present disclosure, it is not sufficient to satisfy only one of Expression (i) and Expression (ii), but it is a necessary condition to satisfy Expression (i) and Expression (ii) at the same time, for achieving the reduction of the potential fluctuation in a low temperature and low humidity environment and the reduction of the leakage at the time of the high electric field, at a high level.

In the above Japanese Patent Application Laid-Open Nos. 2002-287396 and 2010-230746, only the degree of hydrophobicity or only the weight percentage of the Si element has been specified, and there has not been a technical suggestion that there is a more favorable value of the weight percentage of the Si element in the titanium oxide particle according to the average primary particle size of the titanium oxide particles, and that the titanium oxide particle needs to satisfy the degree of hydrophobicity and the weight percentage of the Si element at the same time.

In addition, the values of α and β×γ are not generally values which correlate to each other. In other words, the values do not have a nature that if one of Expression (i) and Expression (ii) is satisfied, the other expression is automatically satisfied. In order to satisfy these two expressions at the same time, it is necessary to appropriately select a type of organosilicon compound and to appropriately treat the surface of the titanium oxide particle with the selected organosilicon compound.

For example, when it is intended to treat the surface with an organosilicon compound in which an alkyl group has a long chain length such as octyltriethoxysilane, the value of a becomes too large compared to the value of β×γ, and accordingly, it is not easy to satisfy Expression (i) and Expression (ii) at the same time. In addition, similarly, when it is intended to treat the surface with an organosilicon compound in which an alkyl group has a short chain length such as methyltrimethoxysilane, the value of a becomes almost 0 compared to the value of β×γ, and accordingly, it is not easy to satisfy two Expressions (i) and (ii) at the same time.

The electrophotographic photosensitive member of the present disclosure has a support, an undercoat layer formed on the support, a charge generation layer formed directly on the undercoat layer, and a charge transport layer formed on the charge generation layer.

FIG. 1 is a view illustrating one example of a layer configuration of the electrophotographic photosensitive member of the present disclosure. In FIG. 1, the electrophotographic photosensitive member has a support 101, an undercoat layer 102, a charge generation layer 104, and a charge transport layer 105.

(Support)

The support is preferably formed from a material having electroconductivity (an electroconductive support), and for example, a support made of a metal such as aluminum, iron, nickel, copper and gold, or an alloy of these metals can be used. In addition, examples of the support includes a support in which a thin film of a metal such as aluminum, chrome, silver and gold is formed on an insulative support such as a polyester resin, a polycarbonate resin, a polyimide resin and glass, or a support in which a thin film of an electroconductive material such as indium oxide and tin oxide is formed on the insulative support. The surface of the support may be subjected to electrochemical treatment such as anodization, wet honing treatment, blast treatment and cutting treatment, in order to improve its electric characteristics and reduce interference fringes.

An electroconductive layer may be provided between the support and the undercoat layer. The electroconductive layer is obtained by forming a coating film of a coating liquid for the electroconductive layer, in which electroconductive particles are dispersed in a resin, on the support, and drying the coating film.

(Undercoat Layer)

An undercoat layer is provided between the support or electroconductive layer and the charge generation layer.

The undercoat layer contains a polyamide resin and a titanium oxide particle surface-treated with an organosilicon compound, and satisfies above Expression (i) and Expression (ii).

The polyamide resin is preferably a polyamide resin which is soluble in an alcohol-based solvent. For example, materials to be preferably used are ternary (6-66-610) copolymerized polyamide, quaternary (6-66-610-12) copolymerized polyamide, N-methoxymethylated nylon, polymerized fatty acid polyamide, a polymerized fatty acid polyamide block copolymer, and copolymerized polyamide having a diamine component.

It is preferable for the crystal system of the titanium oxide particle to be a rutile type or an anatase type, and is more preferable to be a rutile type which is weak in photocatalytic activity, in view of reducing the accumulation of charge. In the case of the rutile type, it is preferable that a ratio of the rutile type is 90% or more. It is preferable that the shape of the titanium oxide particle is spherical, and it is preferable that the average primary particle size β [μm] satisfy Expression (iv): $0.01 \leq \beta \leq 0.05$, in view of reducing the accumulation of charge and the leakage. The titanium oxide particle is surfacetreated with an organosilicon compound, and examples thereof include a compound represented by following Formula (1) and a compound represented by following Formula (2).

(1)

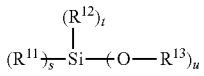

where $R^{11}$ represents a hydrogen atom, a substituted or unsubstituted alkyl group, or a substituted or unsubstituted aryl group; $R^{12}$ represents a hydrogen atom or a methyl group; $R^3$ represents a methyl group or an ethyl group; and s+t+u=4, where s is an integer of 1 or larger, t is an integer of 0 or larger, and u is an integer of 2 or larger; provided that $R^{12}$ does not exist when s+u=4.

(2)

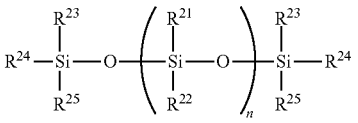

where $R^{21}$ to $R^{25}$ each represents a hydrogen atom, a substituted or unsubstituted alkyl group, or a substituted or unsubstituted aryl group, provided that there are not cases where both of $R^{21}$ and $R^{22}$ are hydrogen atoms, and cases where all of $R^{23}$ to $R^{25}$ are hydrogen atoms; and n is an integer of 0 or larger.

After having been subjected to the surface treatment, the degree of hydrophobicity, α[%], and the weight percentage of the Si element, γ[wt %], are measured (though the measurement method will be described later). By satisfying Expression (i): $10 \leq \alpha \leq 70$ and Expression (ii): $0.015 \leq (\beta \times \gamma) \leq 0.040$ at the same time, both of the reduction of the potential fluctuation in a low temperature and low humidity environment and the reduction of the leakage at the time of the high electric field can be achieved at a high level.

As for a method of treating the surface of the titanium oxide particle with an organosilicon compound, there are a dry method which uses no organic solvent in addition to the organosilicon compound and the titanium oxide particle, and a wet method which uses an organic solvent, and any method may be used as long as Expression (i) and Expression (ii) are satisfied. In the present disclosure, when the amount of the organosilicon compound for surface treatment becomes relatively large with respect to the titanium oxide particle, there is the case where the amount of the organosilicon compound (value of γ), which has been actually used in the surface treatment, with respect to the amount of the charged organosilicon compound, varies depending on a surface treatment method. In this case, an appropriate surface treatment method must be selected so that Expression (i) and Expression (ii) are satisfied.

In addition, the titanium oxide particle may be surface-treated with an inorganic substance before being surface-treated with an organosilicon compound. Even when being surfacetreated with the inorganic substance containing Si element, the titanium oxide particle must be treated so as to satisfy Expression (ii).

Among the cases where Expression (i) and Expression (ii) are satisfied, the cases where Expression (iii): $0.4 \leq (\alpha \times \beta \times \gamma) \leq 1.0$ is also satisfied are more preferable, in order to provide the effect of the present disclosure at a higher level.

It is preferable that a volume ratio of the titanium oxide particles to the polyamide resin (volume of the titanium oxide particles with respect to the volume of the polyamide resin) δ in the undercoat layer be $0.2 \leq \delta \leq 1.2$. When the volume ratio of the titanium oxide particles to the polyamide resin is within the above range, the effect of reducing the accumulation of charge in the present disclosure is sufficiently obtained, and the effect of reducing the leakage in the present disclosure is sufficiently obtained. A more preferable range of δ is $0.30 \leq \delta \leq 0.9$.

It is preferable that a thickness ε[μm] of the undercoat layer satisfy Expression (vi): $1.0 \leq \varepsilon \leq 3.0$. By the ε being within the above range, the effect of reducing the leakage is enhanced and the effect of reducing the accumulation of charge is enhanced.

In particular, among the preferable ranges of δ, β and ε, when the δ, β and ε satisfy Expression (v): $7.0 \leq \delta/(\beta \times \varepsilon) \leq 11.0$, both the reduction of the potential fluctuation in a low temperature and low humidity environment and the reduction of the leakage at the time of the high electric field can be achieved at a high level.

The undercoat layer in the present disclosure may contain an additive such as an organic particle and a leveling agent, in addition to the above polyamide resin and titanium oxide particle, for the purpose of enhancing an effect of preventing the interference fringes of the electrophotographic photosensitive member, or enhancing film forming properties of the undercoat layer. However, it is preferable that the content of the additive in the undercoat layer be 10% by mass or less with respect to the total mass of the undercoat layer.

As for the undercoat layer, two or more undercoat layers may be provided for the purpose of separating the functions. In this case, a layer which is the uppermost layer among the plurality of undercoat layers and at least comes in contact with the charge generation layer must contain a polyamide resin and a titanium oxide particle surface-treated with an organosilicon compound, and satisfy Expression (i) and Expression (ii).

(Charge Generation Layer)

A charge generation layer is provided directly on the undercoat layer.

The charge generation layer contains a charge generation material and a binder resin.

The charge generation material to be used for the charge generation layer includes: an azo pigment, a perylene pigment, an anthraquinone derivative, an anthanthrone derivative, a dibenzpyrenequinone derivative, a pyranthrone derivative, a violanthrone derivative, an isoviolanthrone derivative, an indigo derivative, a thioindigo derivative, phthalocyanine pigments such as metal phthalocyanine and metal-free phthalocyanine and a bisbenzimidazole derivative. Among the materials, the phthalocyanine pigments are preferable. Among the phthalocyanine pigments, oxytitanium phthalocyanine, chlorogallium phthalocyanine and hydroxygallium phthalocyanine are preferable.

The binder resin to be used for the charge generation layer includes: polymers and copolymers of vinyl compounds such as styrene, vinyl acetate, vinyl chloride, acrylic acid esters, methacrylic acid esters, vinylidene fluoride, trifluoroethylene; and a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicon resin and an epoxy resin. Among the resins, the polyester resin, the polycarbonate resin and the polyvinyl acetal resin are preferable, and in particular, the polyvinyl acetal resin is more preferable.

In the charge generation layer, it is preferable for a mass ratio of the charge generation material to the binder resin (charge generation material/binder resin) to be in a range of 10/1 to 1/10, and is more preferable to be in a range of 5/1 to 1/5. It is preferable for a thickness of the charge generation layer to be 0.05 μm or larger and 5 μm or smaller. A solvent to be used in the coating liquid for the charge generation layer includes: an alcohol-based solvent, a sulfoxide-based solvent, a ketone-based solvent, an ether-based solvent, an ester-based solvent and an aromatic hydrocarbon solvent.

(Charge Transport Layer)

A charge transport layer is provided on the charge generation layer.

Examples of the charge transport material which is used in the charge transport layer include: a polycyclic aromatic compound, a heterocyclic compound, a hydrazone compound, a styryl compound, a benzidine compound, a triarylamine compound and triphenylamine: and further include polymers which have groups derived from the compounds, in their main chains or side chains.

The binder resin to be used for the charge transport layer includes: a polyester resin, a polycarbonate resin, a polymethacrylate resin, a polyarylate resin, a polysulfone resin and a polystyrene resin. Among the resins, the polycarbonate resin and the polyarylate resin are preferable. The weight average molecular weight of the binder resin is preferably in a range of 10,000 to 300,000.

In the charge transport layer, it is preferable for a mass ratio of the charge transport material to the binder resin (charge transport material/binder resin) to be in a range of 10/5 to 5/10, and is more preferable to be in a range of 10/8 to 6/10. It is preferable for a thickness of the charge transport layer to be 5 μm or larger and 40 μm or smaller, and is more preferable to be 15 μm or larger and 25 μm or smaller.

A solvent to be used in the coating liquid for the charge transport layer includes: an alcohol-based solvent, a sulfoxide-based solvent, a ketone-based solvent, an ether-based solvent, an ester-based solvent and an aromatic hydrocarbon solvent.

In addition, a protective layer (surface protective layer) which contains an electroconductive particle or a charge transport material and a binder resin may be provided on the charge transport layer. The protective layer may further contain an additive such as a lubricant. In addition, the binder resin itself of the protective layer may have the electroconductivity and the charge transport properties. In the case, the protective layer may not contain the electroconductive particle or a charge transport material other than the binder resin. In addition, the binder resin of the protective layer may be a thermoplastic resin or a curable resin which is cured by heat, light, radiation (electron beam or the like) and the like.

As for a method of forming each layer which constitutes the electrophotographic photosensitive member, such as the electroconductive layer, the undercoat layer, the charge generation layer and the charge transport layer, the following method is preferable: a coating liquid obtained by dissolving and/or dispersing materials constituting each layer in a solvent is applied to form a coating film, and the obtained coating film is dried and/or cured to form each layer. Examples of the method of applying the coating liquid include: a dip coating method (dip coating method), a spray coating method, a curtain coating method, a spin coating method and a ring method. Among the methods, the dip coating method is preferable in view of efficiency and productivity.

(Process Cartridge and Electrophotographic Apparatus)

Figure 2:
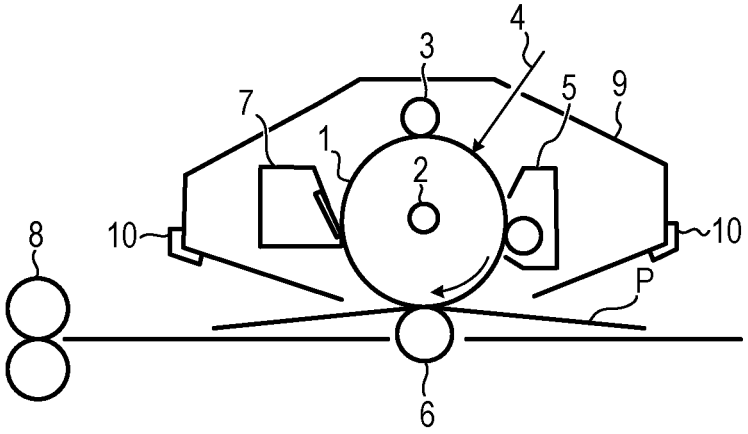
FIG. 2 is a view illustrating a schematic configuration of an electrophotographic apparatus having a process cartridge provided with the electrophotographic photosensitive member.

FIG. 2 illustrates one example of a schematic configuration of an electrophotographic apparatus having a process cartridge provided with an electrophotographic photosensitive member according to the present disclosure.

The electrophotographic apparatus illustrated in FIG. 2 has a cylindrical electrophotographic photosensitive member 1, and is rotationally driven around a shaft 2 in the direction of the arrow at a predetermined peripheral speed. The surface (peripheral surface) of the electrophotographic photosensitive member 1 which is rotationally driven is uniformly charged to a predetermined positive or negative potential by a charging unit 3 (primary charging unit: charging roller or the like). Subsequently, the uniformly charged surface of the electrophotographic photosensitive member 1 is exposed to exposure light (image exposure light) 4 emitted from an exposure unit (not shown), such as slit exposure light or laser beam scanning exposure light. Thus, an electrostatic latent image corresponding to the target image is sequentially formed on the surface of the electrophotographic photosensitive member 1.

The electrostatic latent image formed on the surface of the electrophotographic photosensitive member 1 is then developed by a toner which is contained in the developer of a developing unit 5, and becomes a toner image. Subsequently, the toner image that is formed on and supported by the surface of the electrophotographic photosensitive member 1 is sequentially transferred onto a transfer material (paper or the like) P by a transfer bias applied from a transfer unit (transfer roller or the like) 6. At this time, the transfer material P is delivered to a portion (contact part) between the electrophotographic photosensitive member 1 and the transfer unit 6 from a transfer material supply unit (not shown), is taken out in synchronization with the rotation of the electrophotographic photosensitive member 1, and is delivered.

The transfer material P onto which the toner image has been transferred is separated from the surface of the electrophotographic photosensitive member 1 and introduced to a fixing unit 8 to fix the image there, and is discharged to the outside of the apparatus as an image formed product (print or copy).

The surface of the electrophotographic photosensitive member 1 after the toner image has been transferred is subjected to the removal of the transfer residual developer (transfer residual toner) by a cleaning unit (cleaning blade or the like) 7, and is converted to a clean surface. Subsequently, the surface of the electrophotographic photosensitive member 1, which has been cleaned, is subjected to neutralization treatment by pre-exposure (not shown) to be performed by a pre-exposure unit (not shown), and then is repeatedly used for image formation. Note that the pre-exposure is not necessarily needed, when the charging unit 3 is a contact type charging unit which uses a charging roller or the like, as is illustrated in FIG. 2.

The process cartridge selects a plurality of components among the components such as the above electrophotographic photosensitive member 1, the charging unit 3, the developing unit 5, the transfer unit 6 and the cleaning unit 7, accommodates the selected components in a container, and integrally supports the components. The process cartridge can be configured to be detachably attachable to a main body of the electrophotographic apparatus such as a copying machine and a laser beam printer. In FIG. 2, a process cartridge 9 is formed to be a cartridge which integrally supports the electrophotographic photosensitive member 1, the charging unit 3, the developing unit 5 and the cleaning unit 7, and is detachably attachable to a main body of the electrophotographic apparatus by the use of a guide unit 10 such as a rail of the main body of the electrophotographic apparatus.

EXAMPLES

The present disclosure will be described in more detail below with reference to Examples and Comparative Examples, but the present disclosure is not limited to these Examples. Note that in the Examples and Comparative Examples, "part" means "part by mass".

Example 1

An aluminum cylinder (JIS H4000: 2006 A3003P, aluminum alloy) having a length of 260.5 mm and a diameter of 30 mm was subjected to cutting work (JIS B0601: 2014, ten-point average roughness Rzjis: 0.8 μm), and the resultant was used as a support (electroconductive support).

Next, 100 parts of rutile-type titanium oxide particles (average primary particle size: 50 nm, produced by Tayca Corporation) were stirred and mixed with 400 parts of methanol and 100 parts of methyl ethyl ketone; 5.0 parts of vinyltrimethoxysilane were added thereto; and the mixture was subjected to dispersion treatment in a vertical sand mill with glass beads having a diameter of 1.0 mm, for 8 hours. After the glass beads were removed, methanol and methyl ethyl ketone were distilled off under reduced pressure; and the residue was dried at 120° C. for 3 hours, to thereby obtain rutile-type titanium oxide particles which were surfacetreated with the organosilicon compound.

18.0 parts of the above rutile-type titanium oxide particles which were surface-treated with the organosilicon compound, 4.5 parts of N-methoxymethylated nylon (trade name: Toresin EF-30T, produced by Nagase ChemteX Corporation), and 1.5 parts of copolymerized nylon resin (trade name: Amilan CM8000, produced by Toray Industries, Inc.) were added to a mixed solvent of 90 parts of methanol and 60 parts of 1-butanol, and a dispersion liquid was prepared.

This dispersion liquid was subjected to dispersion treatment in a vertical sand mill with glass beads having a diameter of 1.0 mm, for 5 hours, and the glass beads were removed, to thereby prepare a coating liquid for an undercoat layer. The support was dip-coated with this coating liquid for the undercoat layer, and the obtained coating film was dried at 100° C. for 10 minutes, to thereby form the undercoat layer having a thickness of 2.0 μm.

In this undercoat layer, parameters were $\alpha=45$, $\beta=0.050$, $\gamma=0.70$, $\delta=0.78$ and $\varepsilon=2.0$; and were $\beta\times\gamma=0.035$, $\alpha\times\beta\times\gamma=1.6$ and $\delta/(\beta\times\varepsilon)=7.8$. The value of a was determined by the measurement of methanol wettability of the titanium oxide particle which was surfacetreated with the organosilicon compound. The methanol wettability was measured with a powder wettability tester (trade name: WET100P, manufactured by Rhesca Co., Ltd.), in the following manner. To 200 ml of a beaker, 0.2 g of the titanium oxide particle which was surfacetreated with the organosilicon compound and 50 g of ion-exchanged water were placed, and methanol was added dropwise with a burette while the content of the beaker was slowly stirred. When optical transmittance of the content of the beaker became 10%, the value of the degree of hydrophobicity a was calculated from Expression (vii): $\alpha=100\times a/(a+50)$, where a represented the amount of methanol which was added dropwise up to the time. The value of β was determined after the electrophotographic photosensitive member was produced, from a microscopic image of a cross section of the electrophotographic photosensitive member obtained with a field emission scanning electron microscope (FE-SEM, trade name: S-4800, manufactured by Hitachi High-Technologies Corporation). The value of γ was determined after the surfacetreated rutile-type titanium oxide particle was produced, by: subjecting the particle to analysis with a wavelength dispersive X-ray fluorescence analyzer (XRF, trade name: Axios advanced, manufactured by Malvern Panalytical Ltd.); and calculating from the result of the analysis a content (mass %) of Si element with respect to $TiO_2$ by a software (SpectraEvaluation, version 5.0 L) supposing that only detected Ti element was an oxide.

Next, a hydroxygallium phthalocyanine crystal (charge generation material) in the crystal form was provided which had peaks in Bragg angles)(2θ±0.2°) of 7.5°, 9.9°, 12.5°, 16.3°, 18.6°, 25.1° and 28.3°, in CuKα characteristic X-ray diffraction. 10 parts of this hydroxygallium phthalocyanine crystal, 5 parts of polyvinyl butyral resin (trade name: ESREC BX-1, produced by Sekisui Chemical Co., Ltd.) and 260 parts of cyclohexanone were charged in a vertical sand mill; the mixture was subjected to dispersion treatment with glass beads having a diameter of 1.0 mm, for 1.5 hours; and the glass beads were removed. Next, 240 parts of ethyl acetate were added thereto, to thereby prepare a coating liquid for a charge generation layer. The undercoat layer was dip-coated with this coating liquid for the charge generation layer, and the obtained coating film was dried at 80° C. for 10 minutes, to thereby form the charge generation layer having a thickness of 0.25 μm.

Next, 10 parts of an amine compound (charge transport material) represented by following Formula (3) and 10 parts of a polyarylate resin which had a structural unit represented by following Formula (4-1) and a structure unit represented by following Formula (4-2) at a ratio of 5/5 and had a weight average molecular weight of 100,000 were dissolved in a mixed solvent of 30 parts of dimethoxymethane and 70 parts of chlorobenzene, to prepare thereby a coating liquid for a charge transport layer. The charge generation layer was dip-coated with this coating liquid for the charge transport layer, and the obtained coating film was dried at 120° C. for 60 minutes, to thereby form the charge transport layer having a thickness of 15 μm.

(3)

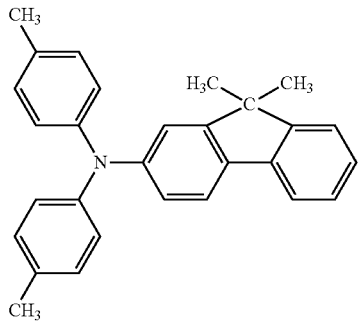

(4-1)

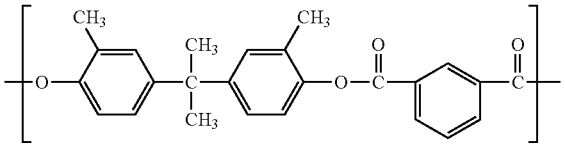

(4-2)

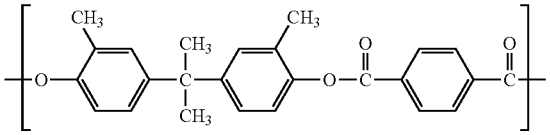

As in the way described above, an electrophotographic photosensitive member was produced which had the undercoat layer, the charge generation layer and the charge transport layer on the support.

(Evaluation of Potential Fluctuation in Low Temperature and Low Humidity Environment)

As an evaluation machine, a laser beam printer manufactured by Hewlett-Packard Company (trade name: HP LaserJet Enterprise 600 M609dn, non-contact development method, printing speed: A4 vertical 71 sheets/minute) was modified, and the potential fluctuation was evaluated. The evaluation machine was modified so that the produced electrophotographic photosensitive member was mounted on a process cartridge for HP LaserJet Enterprise 600 M609dn, and a potential probe (trade name: model 6000B-8, manufactured by Trek Japan) was mounted at a development position. Thereafter, the potential at the central portion (position of approximately 130 mm) of the electrophotographic photosensitive member was measured with a surface electrometer (trade name: model 344, manufactured by Trek Japan). The amount of light for image exposure was set so that the initial dark-part potential ($Vd_0$) out of the surface potential of the electrophotographic photosensitive member became −600 V and the initial light-part potential ($Vl_0$) became −150 V, in an environment having a temperature of 15° C. and a humidity of 10% RH. In the state (state in which there was a potential probe at the portion of the developing machine), at the set amount of exposure light, and in the environment having the temperature of 15° C. and the humidity of 10% RH, 40,000 sheets of images were formed in such an intermittent mode that every time two sheets of images having a printing ratio of 1% were formed on A4 size plain paper, printing was stopped, and the light-part potential ($Vl_f$) after repeated use was measured. Table 1 shows the potential fluctuation $\Delta Vl = Vl_f - Vl_0$ (unit: V) of the light-part potential.

(Evaluation of Leakage Resistance at the Time of High Electric Field)

As an evaluation machine, a laser beam printer manufactured by Hewlett-Packard Company (trade name: HP LaserJet Enterprise 600 M609dn, non-contact development method, printing speed: A4 vertical 71 sheets/minute) was modified, and leakage resistance was evaluated. The produced electrophotographic photosensitive member was mounted on a process cartridge for HP LaserJet Enterprise 600 M609dn; the charging roller was peeled off from the core metal so that the length became 10 cm, and an aluminum sheet having a thickness of 0.5 mm was wound around the remaining portion of 10 cm. In addition, the power supply was modified so as to be capable of controlling the initial dark-part potential ($Vd_1$) out of the surface potential of the electrophotographic photosensitive member to −3,000 V, in an environment having a temperature of 23° C. and a humidity of 50% RH, and the potential was set. In $Vd_1$ set in this state, the amount of the current was continuously measured while a voltage was applied in an environment having the temperature of 23° C. and the humidity of 50% RH, and a period of time when an excessive current was observed was defined as a leak time period. The measurement was performed at four positions, and the average value thereof was determined to be the leak time period, and was classified into the following four levels. As the leak time period is longer, the leakage resistance is higher and thus the effect of reducing the leakage is higher. In the present disclosure, the evaluation ratings A and B were determined to be in preferable levels, and ratings C and D were determined to be in unacceptable levels.

A: the leak time period was 30 minutes or longer.

B: the leak time period was 10 minutes or longer and shorter than 30 minutes.

C: the leak time period was 1 minute or longer and shorter than 10 minutes.

D: the leak time period was shorter than 1 minute.

Example 2

An electrophotographic photosensitive member was produced in the same manner as in Example 1, except that 5.0 parts of vinyltrimethoxysilane were changed to 3.5 parts, in the production of the rutile-type titanium oxide particle which was surfacetreated with the organosilicon compound and was used for the coating liquid for the undercoat layer of Example 1, and the potential fluctuation and the leakage resistance were similarly evaluated. The results are shown in Table 1.

Example 3

An electrophotographic photosensitive member was produced in the same manner as in Example 1, except that 5.0 parts of vinyltrimethoxysilane were changed to 3.0 parts, in the production of the rutile-type titanium oxide particle which was surfacetreated with the organosilicon compound and was used for the coating liquid for the undercoat layer of Example 1, and the potential fluctuation and the leakage resistance were similarly evaluated. The results are shown in Table 1.

Example 4

An electrophotographic photosensitive member was produced in the same manner as in Example 1, except that 5.0 parts of vinyltrimethoxysilane were changed to 2.0 parts, in the production of the rutile-type titanium oxide particle which was surfacetreated with the organosilicon compound and was used for the coating liquid for the undercoat layer of Example 1, and the potential fluctuation and the leakage resistance were similarly evaluated. The results are shown in Table 1.

Example 5

An electrophotographic photosensitive member was produced in the same manner as in Example 1, except that the rutile-type titanium oxide particle which was surfacetreated with the organosilicon compound and was used for the coating liquid for the undercoat layer of Example 1 was produced in the following way, and the potential fluctuation and the leakage resistance were similarly evaluated. The results are shown in Table 1.

100 parts of rutile-type titanium oxide particles (average primary particle size: 50 nm, produced by Tayca Corporation) were stirred and mixed with 500 parts of toluene, and 5.0 parts of vinyltrimethoxysilane were added thereto, and then, the mixture was stirred with a stirrer for 8 hours. Thereafter, the toluene was distilled off under reduced pressure, and the residue was dried at 120° C. for 3 hours, to thereby obtain rutile-type titanium oxide particles which were surfacetreated with the organosilicon compound.

Example 6

An electrophotographic photosensitive member was produced in the same manner as in Example 5, except that 5.0 parts of vinyltrimethoxysilane were changed to 6.0 parts of n-propyltrimethoxysilane, in the production of the rutile-type titanium oxide particle which was surfacetreated with the organosilicon compound and was used for the coating liquid for the undercoat layer of Example 5, and the potential fluctuation and the leakage resistance were similarly evaluated. The results are shown in Table 1.

Example 7

An electrophotographic photosensitive member was produced in the same manner as in Example 5, except that 5.0 parts of vinyltrimethoxysilane were changed to 5.0 parts of isobutyltrimethoxysilane, in the production of the rutile-type titanium oxide particle which was surfacetreated with the organosilicon compound and was used for the coating liquid for the undercoat layer of Example 5, and the potential fluctuation and the leakage resistance were similarly evaluated. The results are shown in Table 1.

Example 8

An electrophotographic photosensitive member was produced in the same manner as in Example 1, except that the coating liquid for the undercoat layer, which was used in Example 1, was prepared in the following way, and the potential fluctuation and the leakage resistance were similarly evaluated. The results are shown in Table 1.

100 parts of rutile-type titanium oxide particles (average primary particle size: 35 nm, produced by Tayca Corporation) were stirred and mixed with 500 parts of toluene, and 4.3 parts of vinyltrimethoxysilane were added thereto. Then, the mixture was stirred with a stirrer for 8 hours. Thereafter, the toluene was distilled off under reduced pressure, and the residue was dried at 120° C. for 3 hours, to thereby obtain rutile-type titanium oxide particles which were surface-treated with the organosilicon compound.

16.0 parts of the above rutile-type titanium oxide particles which were surfacetreated with the organosilicon compound, 6.0 parts of N-methoxymethylated nylon (trade name: Toresin EF-30T, produced by Nagase ChemteX Corporation), and 2.0 parts of copolymerized nylon resin (trade name: Amilan CM8000, produced by Toray Industries, Inc.) were added to a mixed solvent of 90 parts of methanol and 60 parts of 1-butanol, to thereby prepare a dispersion liquid.

This dispersion liquid was subjected to dispersion treatment in a vertical sand mill with glass beads having a diameter of 1.0 mm, for 5 hours, and the glass beads were removed, to thereby prepare a coating liquid for an undercoat layer.

Example 9

An electrophotographic photosensitive member was produced in the same manner as in Example 1, except that the coating liquid for the undercoat layer, which was used in Example 1, was prepared in the following way, and the potential fluctuation and the leakage resistance were similarly evaluated. The results are shown in Table 1.

100 parts of rutile-type titanium oxide particles (average primary particle size: 15 nm, produced by Tayca Corporation) were stirred and mixed with 500 parts of toluene, and 10.0 parts of vinyltrimethoxysilane were added thereto, and then, the mixture was stirred with a stirrer for 8 hours. Thereafter, the toluene was distilled off under reduced pressure, and the residue was dried at 120° C. for 3 hours, to thereby obtain rutile-type titanium oxide particles which were surfacetreated with the organosilicon compound.

13.4 parts of the above rutile-type titanium oxide particles which were surfacetreated with the organosilicon compound, 8.0 parts of N-methoxymethylated nylon (trade name: Toresin EF-30T, produced by Nagase ChemteX Corporation) and 2.6 parts of copolymerized nylon resin (trade name: Amilan CM8000, produced by Toray Industries, Inc.) were added to a mixed solvent of 90 parts of methanol and 60 parts of 1-butanol, to thereby prepare a dispersion liquid.

This dispersion liquid was subjected to dispersion treatment in a vertical sand mill with glass beads having a diameter of 1.0 mm, for 5 hours, and the glass beads were removed, to thereby prepare a coating liquid for an undercoat layer.

Example 10

An electrophotographic photosensitive member was produced in the same manner as in Example 1, except that the rutile-type titanium oxide particle which was surfacetreated with the organosilicon compound and was used for the coating liquid for the undercoat layer of Example 1 was produced in the following way, and the potential fluctuation and the leakage resistance were similarly evaluated. The results are shown in Table 1.

100 parts of rutile-type titanium oxide particles (average primary particle size: 80 nm, produced by Tayca Corporation) were stirred and mixed with 500 parts of toluene, and 10.0 parts of vinyltrimethoxysilane were added thereto, and then, the mixture was stirred with a stirrer for 8 hours. Thereafter, the toluene was distilled off under reduced pressure, and the residue was dried at 120° C. for 3 hours, to thereby obtain rutile-type titanium oxide particles which were surfacetreated with the organosilicon compound.

Example 11

An electrophotographic photosensitive member was produced in the same manner as in Example 1, except that the coating liquid for the undercoat layer, which was used in Example 1, was prepared in the following way, and the potential fluctuation and the leakage resistance were similarly evaluated. The results are shown in Table 1.

19.2 parts of the rutile-type titanium oxide particles which were surfacetreated with the organosilicon compound of Example 1, 3.6 parts of N-methoxymethylated nylon (trade name: Toresin EF-30T, produced by Nagase ChemteX Corporation), and 1.2 parts of copolymerized nylon resin (trade name: Amilan CM8000, produced by Toray Industries, Inc.) were added to a mixed solvent of 90 parts of methanol and 60 parts of 1-butanol, to thereby prepare a dispersion liquid.

This dispersion liquid was subjected to dispersion treatment in a vertical sand mill with glass beads having a diameter of 1.0 mm, for 5 hours, and the glass beads were removed, to thereby prepare a coating liquid for an undercoat layer.

Example 12

An electrophotographic photosensitive member was produced in the same manner as in Example 1, except that the coating liquid for the undercoat layer, which was used in Example 1, was prepared in the following way, and the potential fluctuation and the leakage resistance were similarly evaluated. The results are shown in Table 1.

19.6 parts of the rutile-type titanium oxide particles which were surfacetreated with the organosilicon compound of Example 1, 3.3 parts of N-methoxymethylated nylon (trade name: Toresin EF-30T, produced by Nagase ChemteX Corporation) and 1.1 parts of copolymerized nylon resin (trade name: Amilan CM8000, produced by Toray Industries, Inc.) were added to a mixed solvent of 90 parts of methanol and 60 parts of 1-butanol, to thereby prepare a dispersion liquid.

This dispersion liquid was subjected to dispersion treatment in a vertical sand mill with glass beads having a diameter of 1.0 mm, for 5 hours, and the glass beads were removed, to thereby prepare a coating liquid for an undercoat layer.

Example 13

An electrophotographic photosensitive member was produced in the same manner as in Example 8, except that the coating liquid for the undercoat layer, which was used in Example 8, was prepared in the following way, and the potential fluctuation and the leakage resistance were similarly evaluated. The results are shown in Table 1.

14.4 parts of the rutile-type titanium oxide particles which were surfacetreated with the organosilicon compound of Example 8, 7.2 parts of N-methoxymethylated nylon (trade name: Toresin EF-30T, produced by Nagase ChemteX Corporation) and 2.4 parts of copolymerized nylon resin (trade name: Amilan CM8000, produced by Toray Industries, Inc.) were added to a mixed solvent of 90 parts of methanol and 60 parts of 1-butanol, to thereby prepare a dispersion liquid.

This dispersion liquid was subjected to dispersion treatment in a vertical sand mill with glass beads having a diameter of 1.0 mm, for 5 hours, and the glass beads were removed, to thereby prepare a coating liquid for an undercoat layer.

Example 14

An electrophotographic photosensitive member was produced in the same manner as in Example 10, except that the coating liquid for the undercoat layer, which was used in Example 10, was prepared in the following way, and the potential fluctuation and the leakage resistance were similarly evaluated. The results are shown in Table 1.

19.2 parts of the rutile-type titanium oxide particles which were surfacetreated with the organosilicon compound of Example 10, 3.6 parts of N-methoxymethylated nylon (trade name: Toresin EF-30T, produced by Nagase ChemteX Corporation) and 1.2 parts of copolymerized nylon resin (trade name: Amilan CM8000, produced by Toray Industries, Inc.) were added to a mixed solvent of 90 parts of methanol and 60 parts of 1-butanol, to thereby prepare a dispersion liquid.

This dispersion liquid was subjected to dispersion treatment in a vertical sand mill with glass beads having a diameter of 1.0 mm, for 5 hours, and the glass beads were removed, to thereby prepare a coating liquid for an undercoat layer.

Examples 15 to 18

Electrophotographic photosensitive members were produced in the same manner as in Example 1, except that the thickness ε [μm] of the undercoat layer which was used in Example 1 was changed as in Table 1, and the potential fluctuation and the leakage resistance were similarly evaluated. The results are shown in Table 1.

Example 19

An electrophotographic photosensitive member was produced in the same manner as in Example 2, except that the undercoat layer which was used in Example 2 was formed in the following way, and the potential fluctuation and the leakage resistance were similarly evaluated. The results are shown in Table 1.

17.1 parts of the rutile-type titanium oxide particles which were surfacetreated with the organosilicon compound of Example 2, 5.2 parts of N-methoxymethylated nylon (trade name: Toresin EF-30T, produced by Nagase ChemteX Corporation) and 1.7 parts of copolymerized nylon resin (trade name: Amilan CM8000, produced by Toray Industries, Inc.) were added to a mixed solvent of 90 parts of methanol and 60 parts of 1-butanol, to thereby prepare dispersion liquid.

This dispersion liquid was subjected to dispersion treatment in a vertical sand mill with glass beads having a diameter of 1.0 mm, for 5 hours, and the glass beads were removed, to thereby prepare a coating liquid for an undercoat layer. The support was dip-coated with this coating liquid for the undercoat layer, and the obtained coating film was dried at 100° C. for 10 minutes, to thereby form the undercoat layer having a thickness of 1.5 μm.

Example 20

An electrophotographic photosensitive member was produced in the same manner as in Example 1, except that the coating liquid for the undercoat layer, which was used in Example 1, was prepared in the following way, and the potential fluctuation and the leakage resistance were similarly evaluated. The results are shown in Table 1.

100 parts of rutile-type titanium oxide particles (average primary particle size: 15 nm, produced by Tayca Corporation) were stirred and mixed with 500 parts of toluene, and 10.0 parts of isobutyltrimethoxysilane were added thereto, and then, the mixture was stirred with a stirrer for 8 hours. Thereafter, the toluene was distilled off under reduced pressure, and the residue was dried at 120° C. for 3 hours, to thereby obtain rutile-type titanium oxide particles which were surfacetreated with the organosilicon compound.

12.0 parts of the above rutile-type titanium oxide particles which were surfacetreated with the organosilicon compound, 6.0 parts of N-methoxymethylated nylon (trade name: Toresin EF-30T, produced by Nagase ChemteX Corporation) and 3.0 parts of copolymerized nylon resin (trade name: Amilan CM8000, produced by Toray Industries, Inc.) were added to a mixed solvent of 90 parts of methanol and 60 parts of 1-butanol, to thereby prepare a dispersion liquid.

This dispersion liquid was subjected to dispersion treatment in a vertical sand mill with glass beads having a diameter of 1.0 mm, for 5 hours, and the glass beads were removed, to thereby prepare a coating liquid for an undercoat layer.

Comparative Example 1

An electrophotographic photosensitive member was produced in the same manner as in Example 5, except that 5.0 parts of vinyltrimethoxysilane were changed to 3.0 parts, in the production of the rutile-type titanium oxide particle which was surfacetreated with the organosilicon compound and was used for the coating liquid for the undercoat layer of Example 5, and the potential fluctuation and the leakage resistance were similarly evaluated. The results are shown in Table 1.

Comparative Example 2

An electrophotographic photosensitive member was produced in the same manner as in Example 1, except that the rutile-type titanium oxide particle which was surfacetreated with the organosilicon compound and was used for the coating liquid for the undercoat layer of Example 1, was produced in the following way, and the potential fluctuation and the leakage resistance were similarly evaluated. The results are shown in Table 1.

100 parts of rutile-type titanium oxide particles (average primary particle size: 50 nm, manufactured by Tayca Corporation) were dried at 100° C. for 10 minutes while being stirred by a Henschel mixer. Then, while the resultant particles were heated and stirred at 80° C. for 1 hour, 3.0 parts of vinyltrimethoxysilane were sprayed with nitrogen gas onto the particles which were being stirred, to obtain thereby rutile-type titanium oxide particles which were surfacetreated with an organosilicon compound.

Comparative Example 3

An electrophotographic photosensitive member was produced in the same manner as in Example 5, except that 5.0 parts of vinyltrimethoxysilane were changed to 5.0 parts of methyltrimethoxysilane, in the production of the rutile-type titanium oxide particle which was surfacetreated with the organosilicon compound and was used for the coating liquid for the undercoat layer of Example 5, and the potential fluctuation and the leakage resistance were similarly evaluated. The results are shown in Table 1.

Comparative Example 4

An electrophotographic photosensitive member was produced in the same manner as in Example 5, except that 5.0 parts of vinyltrimethoxysilane were changed to 5.0 parts of octyltrimethoxysilane, in the production of the rutile-type titanium oxide particle which was surfacetreated with the organosilicon compound and was used for the coating liquid for the undercoat layer of Example 5, and the potential fluctuation and the leakage resistance were similarly evaluated. The results are shown in Table 1.

Comparative Example 5

An electrophotographic photosensitive member was produced in the same manner as in Example 16, except that the rutile-type titanium oxide particle which was surfacetreated with the organosilicon compound and was used for the coating liquid for the undercoat layer of Example 16, was produced in the following way, and the potential fluctuation and the leakage resistance were similarly evaluated. The results are shown in Table 1.

100 parts of rutile-type titanium oxide particles (average primary particle size: 35 nm, produced by Tayca Corporation) were stirred and mixed with 500 parts of toluene, and 5.0 parts of hexyltrimethoxysilane were added thereto, and then, the mixture was stirred with a stirrer for 8 hours. Thereafter, the toluene was distilled off under reduced pressure, and the residue was dried at 120° C. for 3 hours, to thereby obtain rutile-type titanium oxide particles which were surfacetreated with the organosilicon compound.

Comparative Example 6

An electrophotographic photosensitive member was produced in the same manner as in Example 11, except that the rutile-type titanium oxide particle which was surfacetreated with the organosilicon compound and was used for the coating liquid for the undercoat layer of Example 11, was produced in the following way, and the potential fluctuation and the leakage resistance were similarly evaluated. The results are shown in Table 1.

100 parts of rutile-type titanium oxide particles (average primary particle size: 50 nm, produced by Tayca Corporation) were stirred and mixed with 500 parts of toluene, and 5.0 parts of isobutyltrimethoxysilane were added thereto, and then, the mixture was stirred with a stirrer for 8 hours. Thereafter, the toluene was distilled off under reduced pressure, and the residue was dried at 120° C. for 3 hours, to thereby obtain rutile-type titanium oxide particles which were surface-treated with the organosilicon compound.

Comparative Example 7

An electrophotographic photosensitive member was produced in the same manner as in Example 16, except that the coating liquid for the undercoat layer, which was used in Example 16, was prepared in the following way, and the potential fluctuation and the leakage resistance were similarly evaluated. The results are shown in Table 1.

100 parts of anatase-type titanium oxide particles (average primary particle size: 30 nm, produced by Tayca Corporation) were stirred and mixed with 500 parts of toluene, and 3.0 parts of fluorinated ethyltrimethoxysilane were added thereto, and then, the mixture was stirred with a stirrer for 8 hours. Thereafter, the toluene was distilled off under reduced pressure, and the residue was dried at 120° C. for 3 hours, to thereby obtain anatase-type titanium oxide particles which were surfacetreated with the organosilicon compound.

18.0 parts of the anatase-type titanium oxide particles which were surfacetreated with the organosilicon compound and 6.0 parts of copolymerized nylon resin (trade name: X1010, produced by Daicel-Evonik Ltd.) were added to a mixed solvent of 90 parts of methanol and 60 parts of 1-butanol, to thereby prepare a dispersion liquid.

This dispersion liquid was subjected to dispersion treatment in a vertical sand mill with glass beads having a diameter of 1.0 mm, for 5 hours, and the glass beads were removed, to thereby prepare a coating liquid for an undercoat layer.

Comparative Example 8

An electrophotographic photosensitive member was produced in the same manner as in Comparative Example 7, except that 3.0 parts of fluorinated ethyltrimethoxysilane were changed to 1.5 parts of octyltrimethoxysilane, in the production of the anatase-type titanium oxide particle which was surfacetreated with the organosilicon compound and was used for the coating liquid for the undercoat layer of Comparative Example 7, and the potential fluctuation and the leakage resistance were similarly evaluated. The results are shown in Table 1.

Comparative Example 9

An electrophotographic photosensitive member was produced in the same manner as in Example 17, except that the coating liquid for the undercoat layer, which was used in Example 17, was prepared in the following way, and the potential fluctuation and the leakage resistance were similarly evaluated. The results are shown in Table 1.

100 parts of rutile-type titanium oxide particles (average primary particle size: 10 nm, produced by Tayca Corporation) were stirred and mixed with 500 parts of toluene, and 1.0 part of methyl hydrogen polysiloxane was added thereto, and then, the mixture was stirred with a stirrer for 8 hours. Thereafter, the toluene was distilled off under reduced pressure, and the residue was dried at 120° C. for 3 hours, to thereby obtain rutile-type titanium oxide particles which were surfacetreated with the organosilicon compound.

18.0 parts of the above rutile-type titanium oxide particles which were surfacetreated with the organosilicon compound and 6.0 parts of copolymerized nylon resin (trade name: X1010, produced by Daicel-Evonik Ltd.) were added to a mixed solvent of 90 parts of methanol and 60 parts of 1-butanol, to thereby prepare a dispersion liquid.

Comparative Example 10

An electrophotographic photosensitive member was produced in the same manner as in Comparative Example 9, except that the rutile-type titanium oxide particle which was surfacetreated with the organosilicon compound and was used for the coating liquid for the undercoat layer of Comparative Example 9, was produced in the following way, and the potential fluctuation was similarly evaluated. The results are shown in Table 1.

100 parts of rutile-type titanium oxide particles (average primary particle size: 35 nm, produced by Tayca Corporation) were stirred and mixed with 500 parts of toluene, and 2.0 parts of methyl hydrogen polysiloxane were added thereto, and then, the mixture was stirred with a stirrer for 8 hours. Thereafter, the toluene was distilled off under reduced pressure, and the residue was dried at 120° C. for 3 hours, to thereby obtain rutile-type titanium oxide particles which were surface-treated with the organosilicon compound.

TABLE 1

| | Organosilicon compound for surface-treatment of titanium oxide particle | Parameter α [%] | β [μm] | γ [wt %] | δ [—] | ε [μm] | Expression (i) α | Expression (ii) β × γ |
|---|---|---|---|---|---|---|---|---|
| Example | | | | | | | | |
| 1 | Vinyltrimethoxy silane | 45 | 0.050 | 0.70 | 0.78 | 2.0 | 45 | 0.035 |
| 2 | Vinyltrimethoxy silane | 30 | 0.050 | 0.60 | 0.78 | 2.0 | 30 | 0.030 |
| 3 | Vinyltrimethoxy silane | 17 | 0.050 | 0.52 | 0.78 | 2.0 | 17 | 0.026 |
| 4 | Vinyltrimethoxy silane | 10 | 0.050 | 0.43 | 0.78 | 2.0 | 10 | 0.022 |
| 5 | Vinyltrimethoxy silane | 26 | 0.050 | 0.54 | 0.78 | 2.0 | 26 | 0.027 |
| 6 | n-Propyltrimethoxysilane | 66 | 0.050 | 0.39 | 0.78 | 2.0 | 66 | 0.020 |
| 7 | Isobutyltrimethoxysilane | 61 | 0.050 | 0.32 | 0.78 | 2.0 | 61 | 0.016 |
| 8 | Vinyltrimethoxysilane | 18 | 0.035 | 0.67 | 0.52 | 2.0 | 18 | 0.023 |
| 9 | Vinyltrimethoxysilane | 20 | 0.015 | 1.76 | 0.33 | 2.0 | 20 | 0.026 |
| 10 | Vinyltrimethoxysilane | 15 | 0.080 | 0.32 | 0.78 | 2.0 | 15 | 0.026 |
| 11 | Vinyltrimethoxysilane | 45 | 0.050 | 0.70 | 1.04 | 2.0 | 45 | 0.035 |
| 12 | Vinyltrimethoxysilane | 45 | 0.050 | 0.70 | 1.16 | 2.0 | 45 | 0.035 |
| 13 | Vinyltrimethoxysilane | 18 | 0.035 | 0.67 | 0.39 | 2.0 | 18 | 0.023 |
| 14 | Vinyltrimethoxysilane | 15 | 0.080 | 0.32 | 1.04 | 2.0 | 15 | 0.026 |
| 15 | Vinyltrimethoxysilane | 45 | 0.050 | 0.70 | 0.78 | 0.5 | 45 | 0.035 |
| 16 | Vinyltrimethoxysilane | 45 | 0.050 | 0.70 | 0.78 | 1.0 | 45 | 0.035 |
| 17 | Vinyltrimethoxysilane | 45 | 0.050 | 0.70 | 0.78 | 3.0 | 45 | 0.035 |
| 18 | Vinyltrimethoxysilane | 45 | 0.050 | 0.70 | 0.78 | 5.0 | 45 | 0.035 |
| 19 | Vinyltrimethoxysilane | 30 | 0.050 | 0.60 | 0.65 | 1.5 | 30 | 0.030 |
| 20 | Isobutyltrimethoxysilane | 70 | 0.015 | 1.03 | 0.26 | 2.0 | 70 | 0.015 |
| Comparative Example | | | | | | | | |
| 1 | Vinyltrimethoxysilane | 0 | 0.050 | 0.30 | 0.78 | 2.0 | 0 | 0.015 |
| 2 | Vinyltrimethoxysilane | 0 | 0.050 | 0.46 | 0.78 | 2.0 | 0 | 0.023 |
| 3 | Methyltrimethoxysilane | 0 | 0.050 | 0.37 | 0.78 | 2.0 | 0 | 0.019 |

TABLE 1-continued

| | | | | | | | | |
|---|---|---|---|---|---|---|---|---|
| 4 | Octyltrimethoxysilane | 78 | 0.050 | 0.29 | 0.78 | 2.0 | 78 | 0.015 |
| 5 | Hexyltrimethoxysilane | 60 | 0.035 | 2.35 | 0.78 | 1.0 | 60 | 0.082 |
| 6 | Isobutyltrimethoxysilane | 60 | 0.050 | 3.07 | 1.04 | 2.0 | 60 | 0.154 |
| 7 | Fluorinated ethyltrimethoxysilane | 85 | 0.030 | 0.41 | 0.78 | 1.0 | 85 | 0.012 |
| 8 | Octyltrimethoxysilane | 23 | 0.030 | 0.19 | 0.78 | 2.0 | 23 | 0.006 |
| 9 | Methyl hydrogen polysiloxane | 19 | 0.010 | 1.16 | 0.72 | 3.0 | 19 | 0.012 |
| 10 | Methyl hydrogen polysiloxane | 37 | 0.035 | 2.21 | 0.72 | 3.0 | 37 | 0.077 |

| | Expression (iii) $\alpha \times \beta \times \gamma$ | Expression (iv) $\beta$ | Expression (v) $\delta/(\beta \times \varepsilon)$ | Expression (vi) $\varepsilon$ | Potential fluctuation $\Delta VI$ | Leakage resistance |
|---|---|---|---|---|---|---|
| Example | | | | | | |
| 1 | 1.6 | 0.05 | 7.8 | 2.0 | 58 | A |
| 2 | 0.9 | 0.05 | 7.8 | 2.0 | 47 | A |
| 3 | 0.4 | 0.05 | 7.8 | 2.0 | 44 | A |
| 4 | 0.2 | 0.05 | 7.8 | 2.0 | 39 | B |
| 5 | 0.7 | 0.05 | 7.8 | 2.0 | 42 | A |
| 6 | 1.3 | 0.05 | 7.8 | 2.0 | 55 | A |
| 7 | 1.0 | 0.05 | 7.8 | 2.0 | 47 | A |
| 8 | 0.4 | 0.04 | 7.4 | 2.0 | 44 | A |
| 9 | 0.5 | 0.02 | 11.0 | 2.0 | 51 | A |
| 10 | 0.4 | 0.08 | 4.9 | 2.0 | 56 | B |
| 11 | 1.6 | 0.05 | 10.4 | 2.0 | 44 | A |
| 12 | 1.6 | 0.05 | 11.6 | 2.0 | 38 | B |
| 13 | 0.4 | 0.04 | 5.6 | 2.0 | 54 | A |
| 14 | 0.4 | 0.08 | 6.5 | 2.0 | 49 | B |
| 15 | 1.6 | 0.05 | 31.2 | 0.5 | 44 | B |
| 16 | 1.6 | 0.05 | 15.6 | 1.0 | 50 | B |
| 17 | 1.6 | 0.05 | 5.2 | 3.0 | 60 | A |
| 18 | 1.6 | 0.05 | 3.1 | 5.0 | 65 | A |
| 19 | 0.9 | 0.05 | 8.7 | 1.5 | 46 | A |
| 20 | 1.1 | 0.02 | 8.7 | 2.0 | 55 | A |
| Comparative Example | | | | | | |
| 1 | 0.0 | 0.05 | 7.8 | 2.0 | 31 | C |
| 2 | 0.0 | 0.05 | 7.8 | 2.0 | 42 | C |
| 3 | 0.0 | 0.05 | 7.8 | 2.0 | 20 | D |
| 4 | 1.1 | 0.05 | 7.8 | 2.0 | 68 | D |
| 5 | 4.9 | 0.04 | 22.3 | 1.0 | 110 | A |
| 6 | 9.2 | 0.05 | 10.4 | 2.0 | 131 | A |
| 7 | 1.0 | 0.03 | 26.2 | 1.0 | 25 | D |
| 8 | 0.1 | 0.03 | 13.1 | 2.0 | 33 | D |
| 9 | 0.2 | 0.01 | 23.9 | 3.0 | 76 | D |
| 10 | 2.9 | 0.04 | 6.8 | 3.0 | 88 | A |

The present disclosure can provide an electrophotographic photosensitive member that reduces the accumulation of charge and the leakage which are caused by the repeated use in a long period of time. In addition, the present disclosure can provide a process cartridge and an electrophotographic apparatus that have the electrophotographic photosensitive member.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-216456, filed Nov. 19, 2018 which is hereby incorporated by reference herein in its entirety.

What is claimed is:

1. An electrophotographic photosensitive member, comprising in this order:

a support;

an undercoat layer comprising a polyamide resin and a titanium oxide particle, the titanium oxide particle having been surface treated with an organosilicon compound:

a charge generation layer; and a charge transport layer, wherein $10 \leq \alpha \leq 70$ and $0.015 \leq (\beta \times \gamma) \leq 0.040$ where $\alpha$ represents a degree of hydrophobicity of the surface treated titanium oxide particle, $\beta$ represents an average primary particle size of the surface treated titanium oxide particles and $\gamma$ represents a weight percentage of an Si element in the surface treated titanium oxide particle.

2. The electrophotographic photosensitive member according to claim 1, wherein the $0.4 \leq (\alpha \times \beta \times \gamma) \leq 1.0$.

3. The electrophotographic photosensitive member according to claim 1, wherein $0.01 \leq \beta \leq 0.05$.

4. The electrophotographic photosensitive member according to claim 1, wherein $7.0 \leq \delta/(\beta \times \varepsilon) \leq 11.0$ where $\delta$ represent a volume of the titanium oxide particles with respect to a volume of the polyamide resin in the undercoat layer, and $\varepsilon$ represents a thickness of the undercoat layer.

5. The electrophotographic photosensitive member according to claim 1, wherein $1.0 \leq \varepsilon \leq 3.0$.

where $\varepsilon$ represents a thickness of the undercoat layer.

6. The electrophotographic photosensitive member according to claim 1, wherein a crystal system of the titanium oxide particle is a rutile type.

7. The electrophotographic photosensitive member according to claim 1, wherein the organosilicon compound is vinyltrimethoxysilane.

8. The electrophotographic photosensitive member according to claim 1, wherein the organosilicon compound is n-propyltrimethoxysilane.

9. The electrophotographic photosensitive member according to claim 1, wherein the organosilicon compound is isobutyltrimethoxysilane.

10. A process cartridge comprising and integrally supporting:

an electrophotographic photosensitive member comprising a support, an undercoat layer, a charge generation layer and a charge transport layer in this order; and at least one unit selected from the group consisting of a charging unit, a developing unit and a cleaning unit; the process cartridge being detachably attachable to a main body of an electrophotographic apparatus, wherein the undercoat layer comprises a polyamide resin and a titanium oxide particle that has been surface treated with an organosilicon compound, $10 \leq \alpha \leq 70$ and $0.015 \leq (\beta \times \gamma) \leq 0.040$ where $\alpha$ represents a degree of hydrophobicity of the surface treated titanium oxide particle, $\beta$ represents an average primary particle size of the surface treated titanium oxide particles and $\gamma$ represents a weight percentage of an Si element in the surface treated titanium oxide particle.

11. An electrophotographic apparatus comprising:

an electrophotographic photosensitive member comprising a support, an undercoat layer, a charge generation layer and a charge transport layer in this order; and a charging unit, an exposure unit, a developing unit and a transfer unit, wherein the undercoat layer comprises a polyamide resin and a titanium oxide particle that has been surface treated with an organosilicon compound, $10 \leq \alpha \leq 70$ and $0.015 \leq (\beta \times \gamma) \leq 0.040$ where $\alpha$ represents a degree of hydrophobicity of the surface treated titanium oxide particle, $\beta$ represents an average primary particle size of the surface treated titanium oxide particles and $\gamma$ represents a weight percentage of an Si element in the surface treated titanium oxide particle.

* * * * *